United States Patent [19]

Watanabe

[11] Patent Number: 5,034,781

[45] Date of Patent: Jul. 23, 1991

[54] IMAGE FORMING WITH TILTING REGISTER ROLLERS TO CORRECT ALIGNMENT

[75] Inventor: Junji Watanabe, Yokohama, Japan

[73] Assignee: Kabushiki Kaisha Toshiba, Kawasaki, Japan

[21] Appl. No.: 531,624

[22] Filed: Jun. 1, 1990

[30] Foreign Application Priority Data

Jun. 7, 1989 [JP] Japan ..... 1-144944
Aug. 4, 1989 [JP] Japan ..... 1-202329

[51] Int. Cl.[5] ..... G03G 21/00
[52] U.S. Cl. ..... 355/317; 100/158 R; 100/164; 271/228; 355/271
[58] Field of Search ..... 355/317, 271, 282, 290; 271/227, 228, 246; 100/158 R, 164; 219/216, 469, 470, 471

[56] References Cited

U.S. PATENT DOCUMENTS 4,095,879. 6/1978 Katayama et al. ..... 355/317 X
4,772,913 9/1988 Watanabe ..... 355/326

FOREIGN PATENT DOCUMENTS 0097075 6/1983 Japan ..... 355/317
0075754 4/1986 Japan ..... 271/228

*Primary Examiner*—A. T. Grimley
*Assistant Examiner*—Christopher Horgan
*Attorney, Agent, or Firm*—Foley & Lardner

[57] ABSTRACT

In a copying machine inclucing paired register rollers which are driven after a front end of a paper supplied from a paper supply cassette comes in contact with the paired register rollers and is aligned and a copying unit for copying a document image on the paper fed by the paired register rollers, the paired register rollers are mounted on a frame via self-aligning bearings, two paper front detecting sensors are disposed on both sides of the center of a feeding path between the paired register rollers and the copying unit, the direction and angle of tilt of the paper held by the paired register rollers with respect to the feeding direction of the paper are detected based on a difference between timings at which the two sensors are turned on, and the paired register rollers are tilted in a direction opposite to the detected direction by the detected angle, thus correcting the tilt of the paper.

15 Claims, 12 Drawing Sheets

IMAGE FORMING WITH TILTING REGISTER ROLLERS TO CORRECT ALIGNMENT

BACKGROUND OF THE INVENTION

1. Field of the Invention

This invention relates to an image forming apparatus such as a copying machine or printer, and more particularly to an image forming apparatus capable of correcting directional misalignment of paper caused when paper is supplied and fed into the image forming unit.

2. Description of the Related Art

In the above image forming apparatus, paper taken out from a paper supply cassette first reaches paired register rollers, and the front end of the paper comes into contact with the paired register rollers so that the directional misalignment of the paper (the state in which the paper is fed with an inclination with respect to the feeding direction) can be corrected. After this, the paired register rollers are driven in synchronism with the image forming operation to feed the paper into the image forming unit.

However, the directional misalignment of the paper cannot be sometimes corrected by simply touching the paper against the paired register rollers. Further, the directional misalignment of the paper may occur when the paper is fed by the paired register rollers. For this reason, in the conventional image forming apparatus, the directional misalignment of the paper cannot be completely corrected.

SUMMARY OF THE INVENTION

An object of this invention is to correct the directional misalignment of an image forming medium in an image forming apparatus for forming an image on the image forming medium while feeding the medium.

An image forming apparatus of this invention comprises means for forming an image on an image forming medium; feeding means for feeding the image forming medium to the image forming means; means for detecting a tilt of the image forming medium fed by the feeding means with respect to the feeding direction; and means for tilting the feeding means according to the tilt detected by the detection means to correct the tilt of the image forming medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
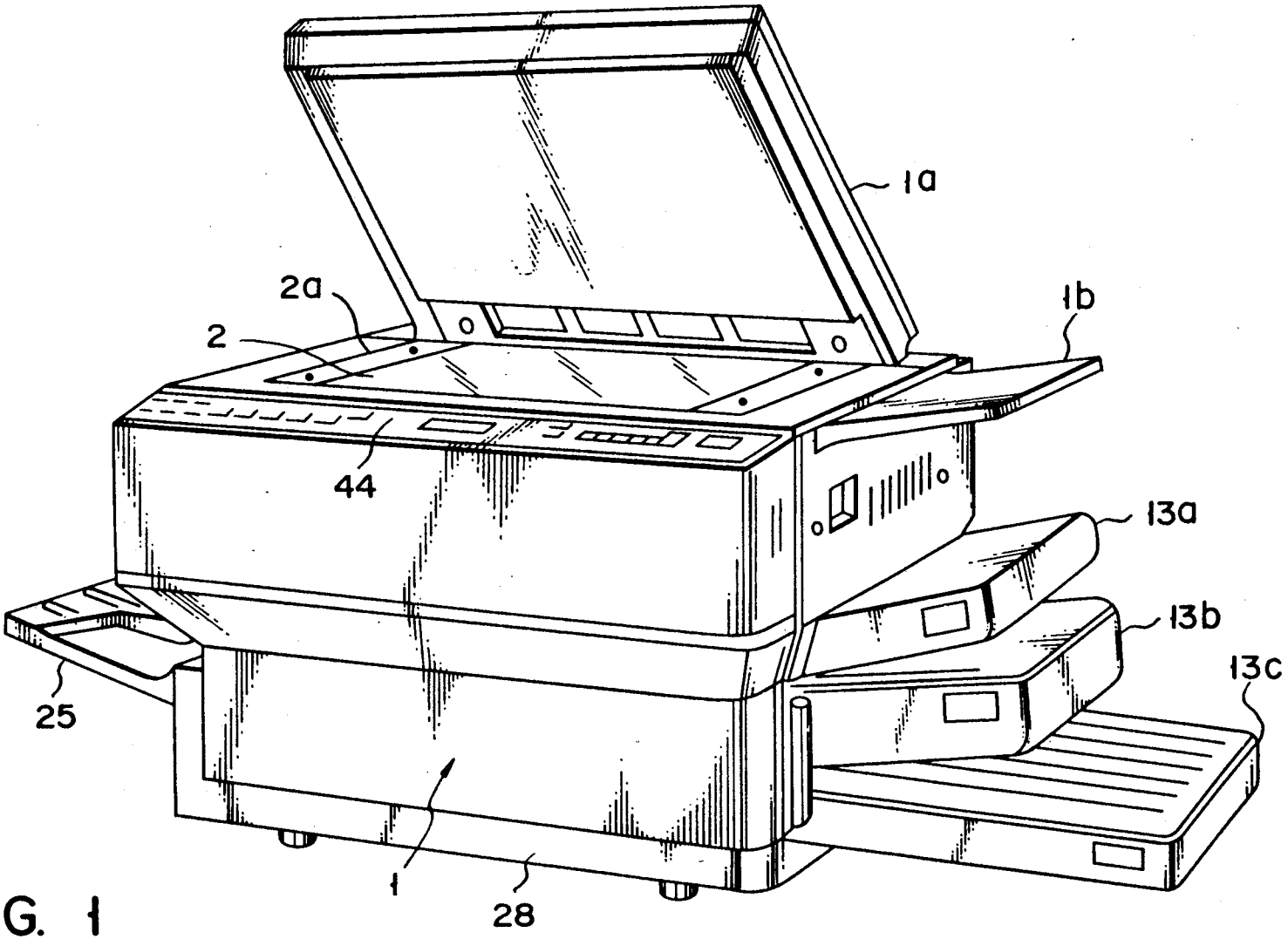
FIG. 1 is a perspective view of a copying machine according to a first embodiment of an image forming apparatus device of this invention.
Figure 2:
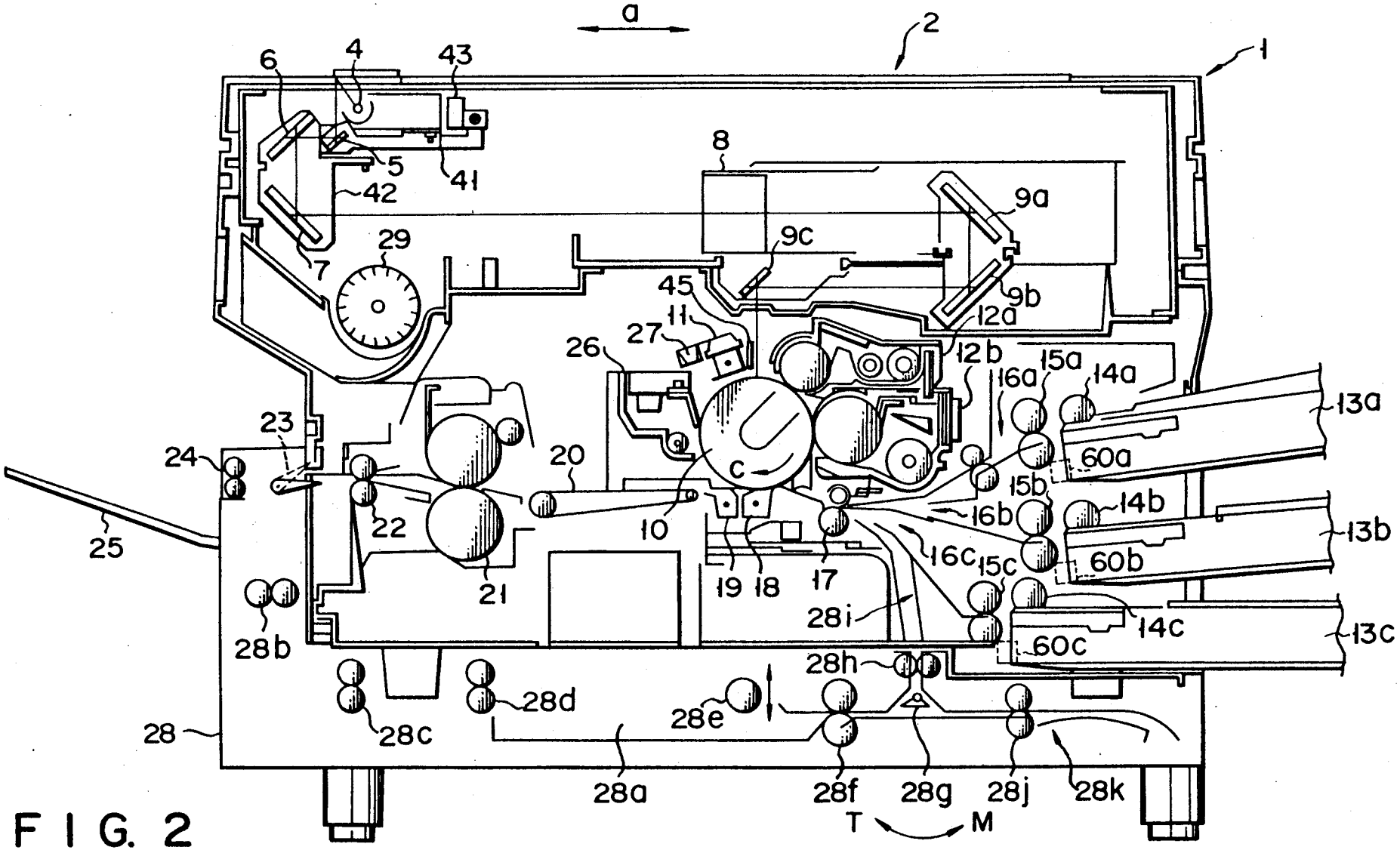
FIG. 2 is a cross sectional view showing the internal structure of the copying machine.

There will now be described an embodiment of an image forming apparatus according to the present invention with reference to the accompanying drawings. A copying machine is explained as a first embodiment. FIG. 1 is a perspective view of the first embodiment and FIG. 2 is a cross sectional view showing the internal structure. A document table (transparent glass plate) 2 for holding a document to be copied is fixed on the upper surface of the main body 1 of the copying machine. A fixed scale 2*a* used as a reference position when the document is set on the document table 2 is provided on the document table 2, and a freely opening/closing document cover 1*a* and a work table 1*b* are mounted near the document table 2.

A document (not shown) set on the document table 2 is exposed and scanned by reciprocally moving an optical system including an exposure lamp 4, mirrors 5, 6, and 7 along the under surface of the document table 2 in a direction indicated by an arrow a (FIG. 2). In this case, the mirrors 6 and 7 are moved at a speed half that of the mirror 5 so as to keep the length of the optical path constant during the scanning. Light reflected from the document when it is scanned by the optical system, that is, light radiated from an exposure lamp 4 and reflected by the document is reflected by the mirrors 5, 6, and 7, passes a variable-magnification lens block 8, is reflected by mirrors 9*a*, 9*b*, and 9*c* and is then projected onto a photosensitive drum 10 to form an image on the photosensitive drum 10.

The photosensitive drum 10 is rotated in a direction indicated by an arrow c and the surface thereof is electrified by an electrifying charger 11. After this, an image is subjected to a slit-exposure to form an electrostatic latent image on the surface of the photosensitive drum 10. The electrostatic latent image is converted into a visible image by selectively operating developing units 12*a* and 12*b* containing red or black toner to attach the toner to the image.

Sheets of paper (image forming medium) P are taken out one by one from a selected one of an upper paper supply cassette 13*a*, a middle paper supply cassette 13*b*, and a lower paper supply cassette 13*c* by a delivery roller 14*a*, 14*b*, or 14*c* and paired rollers 15*a*, 15*b*, or 15*c*, guided to paired register rollers 17 via a paper guiding path 16*a*, 16*b*, or 16*c*, and then fed to an image transferring unit by the paired register rollers 17. In this case, the paper supply cassettes 13*a*, 13*b*, and 13*c* are removably mounted on the lower right portion of the main body 1 and one of them can be selected by an operating panel as will be described later.

The cassette sizes of the paper supply cassettes 13*a*, 13*b*, and 13*c* can be detected by cassette size detection switches 60*a*, 60*b*, and 60*c*, respectively. The cassette size detection switches 60*a*, 60*b*, and 60*c* are constructed by a plurality of microswitches which are selectively turned on or off when a cassette of a predetermined size is inserted.

The paper P fed to the image transferring unit is set in close contact with the surface of the photosensitive drum 10 in the position of a transferring charger 18 so that the toner image on the photosensitive drum 10 can be transferred to the paper by the effect of the charger 18. The image transferred paper P is electrostatically peeled off from the photosensitive drum 10 by the effect of a peel-off charger 19, fed by a conveyer belt 20 to a fixing roller 21 used as a fixing unit and disposed at the end thereof and then passes through the fixing roller 21 with the transferred image fixed thereon. The paper P having the image fixed thereon is discharged onto a tray 25 disposed outside the main body 1 by paired delivery rollers 22, a distributing gate 23 set in the position indicated by a solid line and paired paper discharging rollers 24.

The remaining toner on the surface of the photosensitive drum 10 used for transferring the image is removed by a cleaner 26, and the resilient image is erased by a de-electrifying lamp 27, and thus the photosensitive drum 10 is returned to the original state. Further, a cooling fan 29 for preventing the temperature rise in the main body 1 is provided.

A multiple copying unit 28 for copying images on both surfaces of one sheet of paper and copying multiple images on one surface of the paper is disposed below the main body 1 of the copying machine. The distributing gate 23, paired paper discharging rollers 24 (described above) and paired rollers 28*b*, 28*c*, and 28*d* for guiding the paper supplied by the distributing gate 23 to a collecting section 28*a* are disposed in the multiple copying unit 28. A delivery roller 28*e* for delivering paper temporarily stored in the collecting section 28*a* is disposed in the collecting section 28*a*. The delivery roller 28*e* can be moved in a vertical direction as indicated by an arrow according to the thickness (number of sheets) of the stacked paper. The paper delivered by the delivery roller 28*e* is guided to a control gate 28*g* via paired separation rollers 28*f* for feeding the paper one by one.

The control gate 28*g* is rotated in a direction indicated by an arrow M to guide the paper to the paired register rollers 17 via paired feeding rollers 28*h* and a paper guiding path 28*i* when the multiple copying operation is effected. When the images are copied on both surfaces, the control gate 28*g* is set into the state shown in the drawing to guide the paper to an inverting section 28*k* via paired feeding rollers 28*j*. When the paper is received into the inverting section 28*k*, the control section 28*g* is rotated in a direction indicated by an arrow T in the drawing to guide the paper fed by the paired feeding rollers 28*j* to the paired register rollers 17 via the paired feeding rollers 28*h* and paper guiding path 28*i*.

Further, the exposure lamp 4 and mirror 5 are mounted on a first carriage 41, and the mirrors 6 and 7 are mounted on a second carriage 42. A spot light source 43 which is movable in a direction perpendicular to the traveling direction of the first carriage 41 is mounted on the first carriage 41. In order to specify a desired portion of the document image, the spot light source 43 is moved in a lighting condition according to the operation of keys provided on an operation panel 44 as will be described later.

An erasing array 45 is disposed between the electrifying charger 11 and the developing unit 12*a*. The erasing array 45 has a plurality of light emitting diodes arranged in a lengthwise direction of the photosensitive drum 10, and the light emitting diodes disposed in a range specified by the light spot from the light source 43 are energized in an image forming mode, for example, to remove the charges electrified on the photosensitive drum 10. No latent image is formed on the portion from which the charges are removed even when the portion is exposed to light, and therefore the image is erased.

Figure 3:
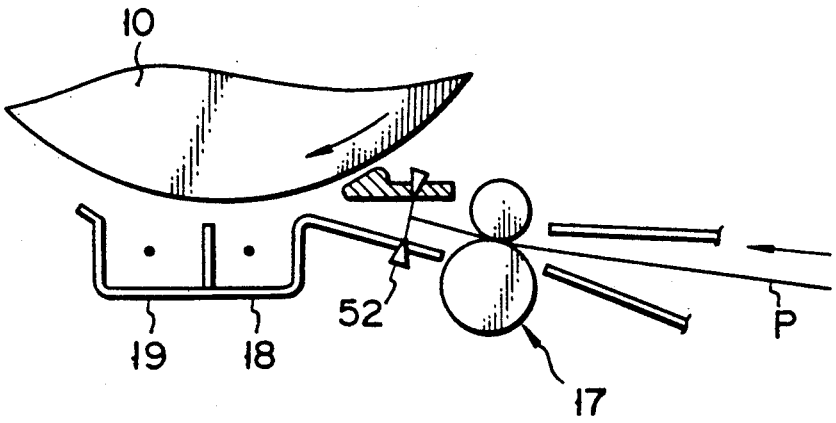
FIG. 3 is a view showing the position in which a paper front end detecting sensor is disposed.
Figure 4:
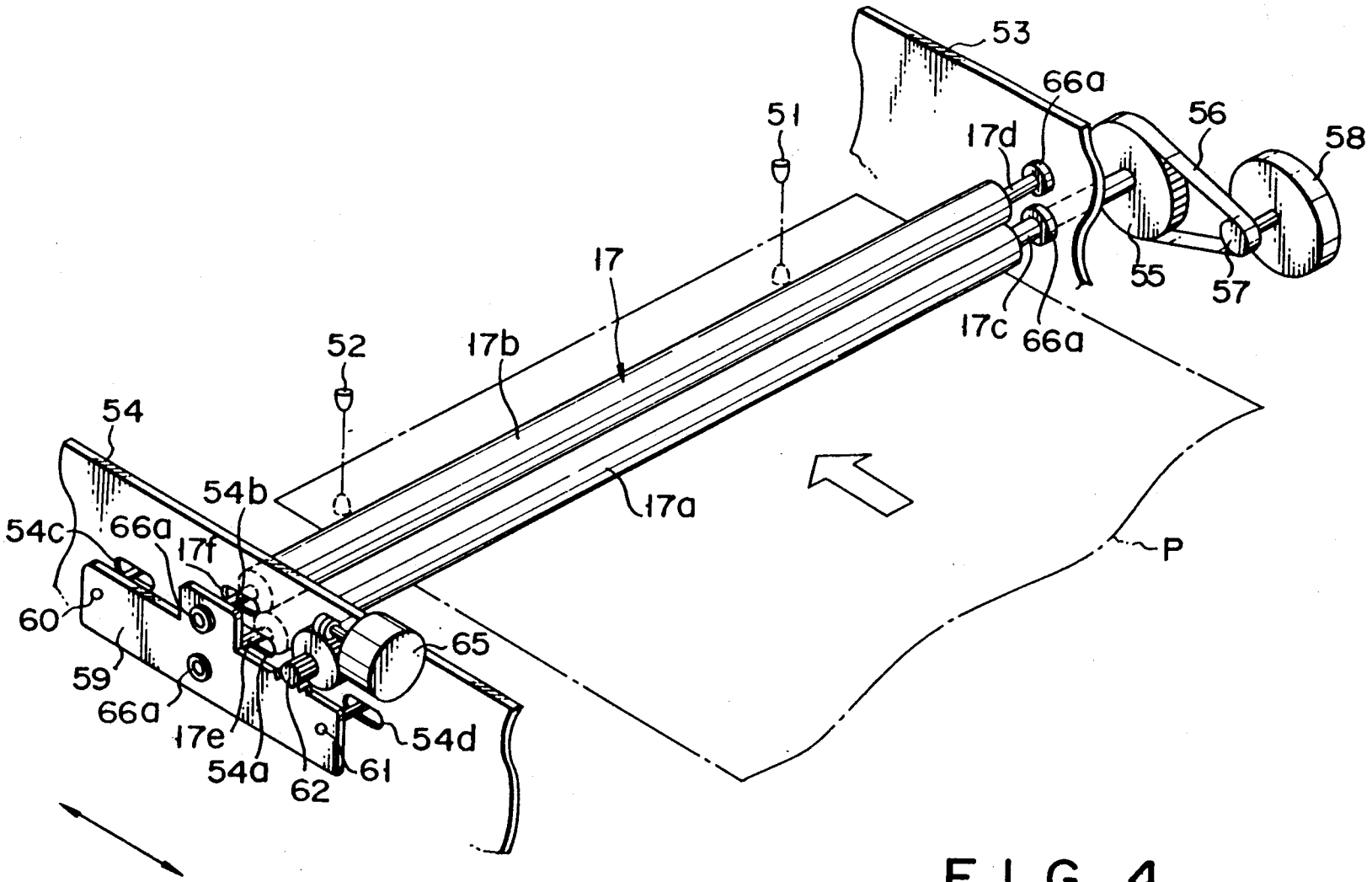
FIG. 4 is a view showing the structure of paired register rollers.

Next, the paired register rollers 17 are explained in detail. As shown in FIGS. 3 and 4, paper front end detection sensors 51 and 52 which are formed of, for example, photocouplers, separated from each other by a preset distance, and separated from the paired register rollers 17 by a preset distance are disposed between the paired register rollers 17 and the transferring charger 18. The paper front end detection sensors 51 and 52 are used to detect the angle and the direction of the directional misalignment of the paper fed by the paired register rollers 17.

As shown in FIG. 4, the paired register rollers 17 are formed of a driving roller 17*a* and a following roller 17*b*. One-end portions 17*c* and 17*d* of the driving roller 17*a* and following roller 17*b* are rotatably mounted on a first frame 53 via self-aligning bearings 66*a* as will be described later. A gear 55 is mounted on a portion projecting from the first frame 53 at the one-end portion 17*c* of the driving roller 17*a*, and the gear 55 is coupled with a gear 57 via a timing belt 56. The gear 57 is driven by a pulse motor 58. That is, when the pulse motor 58 is driven, the driving roller 17*a* is driven to drive the following roller 17*b* which is pressed against the driving roller 17*a*.

Further, the other end portions 17*e* and 17*f* of the driving roller 17*a* and following roller 17*b* are disposed to pass through long holes 54*a* and 54*b* formed in a horizontal direction in a second frame 54. Therefore, the paired register rollers 17 can be tilted in the horizontal direction with the first frame 53 set as a fulcrum.

Figure 5:
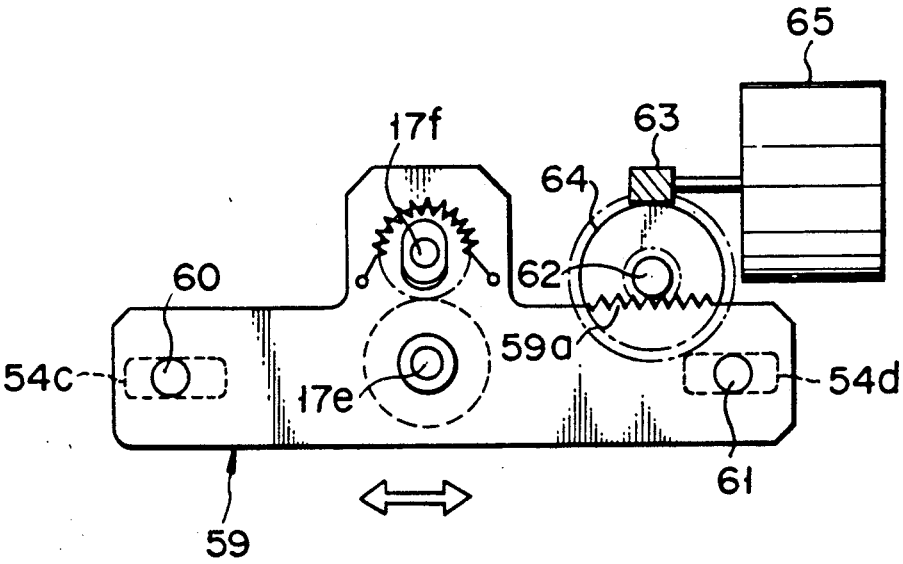
FIG. 5 is a side view of a movable plate mounted on the side portion of the paired register rollers shown in FIG. 4.

Portions of the driving roller 17*a* and following roller 17*b* which protrude from the second frame 54 are rotatably mounted on a movable plate 59 via the self-aligning bearings 66*a* as will be described later. FIG. 5 is a side view of a portion of the movable plate 59. Guide pins 60 and 61 are mounted on both ends of the movable plate 59 in the traveling direction thereof and the guide pins 60 and 61 are disposed to pass through long holes 54*c* and 54*d* formed in a horizontal direction in the second frame 54.

As shown in FIG. 5, a rack gear 59*a* is formed on the upper end portion of the movable plate 59 in a traveling direction thereof, and the rack gear 59*a* is engaged with a pinion 62. The pinion 62 is coupled with a gear 64 which is engaged with a worm gear 63, and the worm gear 63 is driven by a pulse motor 65. Therefore, when the pulse motor 65 is driven, the movable plate 59 is moved in the horizontal direction and the paired register rollers 17 are tilted in the horizontal direction with the first frame 53 set as the fulcrum.

Figure 6:
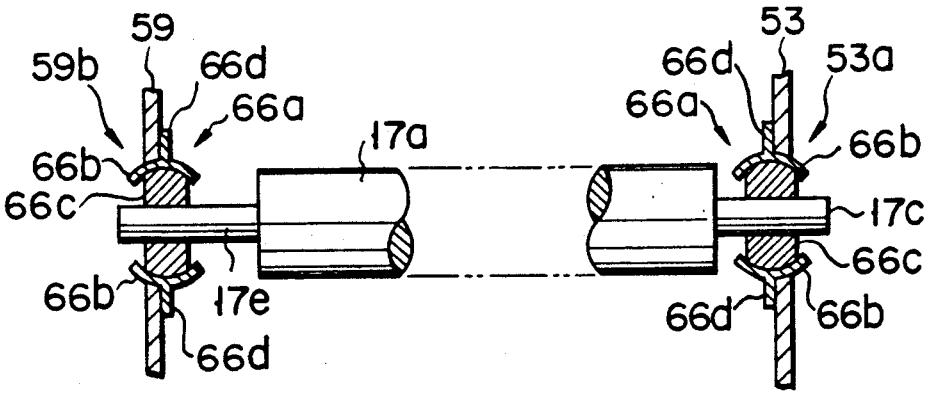
FIG. 6 is a cross sectional view of self-aligning bearings for holding the paired register rollers.

FIG. 6 shows the construction of the self-aligning bearings 66*a*. Since the self-aligning bearings have the same construction, only the self-aligning bearings 66*a* of the driving roller 17*a* are explained. Ball bearings 66*c* are disposed inside holding members 66*b* with a cross section of circular arc, and shafts 17*c* and 17*e* are inserted into the respective ball bearings 66*c*. Flanges 66*d* are formed on the central portions of the peripheral surfaces of the respective holding members 66*b*, and those portions of the holding members 66*b* which lie on the outer side of the flanges 66*d* are rotatably inserted into respective holes 53*a* and 59*b* respectively formed in the first frame 53 and movable plate 59. Therefore, when the movable plate 59 is moved in the lengthwise direction of the long holes 54*c* and 54*d* formed in the second frame 54, the holding members 66*b* of the self-aligning bearings 66*a* are rotated in the holes 53*a* and 59*b* and the driving roller 17*a* is tilted with the self-aligning bearing 66*a* of the first frame 53 as its center.

Figure 7:
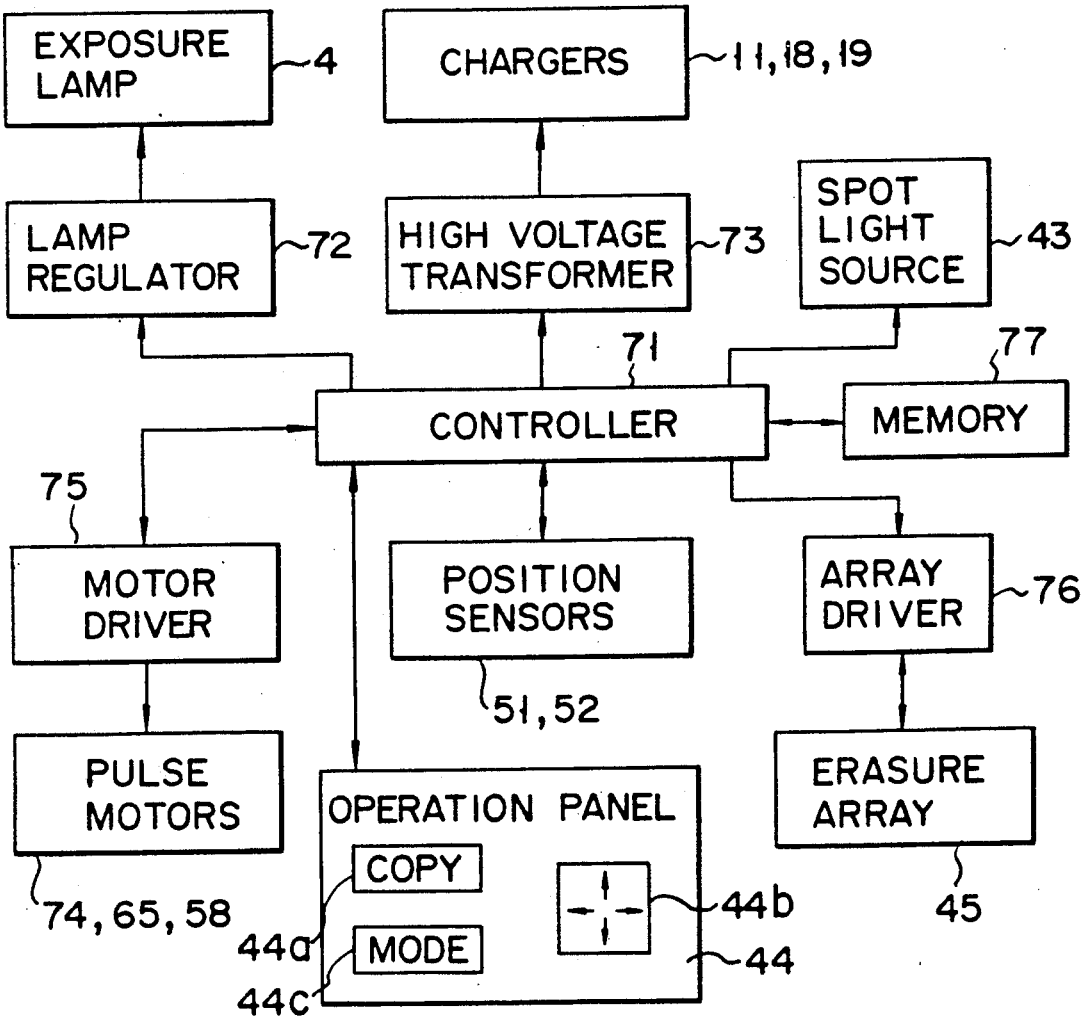
FIG. 7 is a block diagram of a control circuit of the first embodiment.

FIG. 7 is a block diagram showing the construction of a control circuit of this embodiment. A control unit 71 is used to control the entire operation of the main body 1 of the copying machine, and the control unit 71 is connected to the operation panel 44, a lamp regulator 72 for activating the exposure lamp 4, a high voltage transformer 73 for driving the chargers 11, 18, and 19, the spot light source 43, a motor driving unit 75 for driving a pulse motor 74 for driving the photosensitive drum and the like, the pulse motor 58 for driving the paired register rollers 17, the pulse motor 65 for driving the movable plate 59 and the like, the front end detection sensors 51 and 52 for detecting the tilt of the paper, an array driving unit 76 for driving the erasing array 45, and a memory 77 for storing various information and programs necessary for the operation of the control unit 71.

The operation panel 44 includes a copy key 44*a*, a moving key 44*b* for moving the spot light source 43, a mode setting key 44*c* for setting a multiple copy mode in which only a preset area of the same document can be copied on the same side of the paper in a different color, ten keys for setting the number of sheets to be copied, density setting keys for setting the copying density, a display unit for displaying various information and the like.

The erasing array 45 is constituted by a plurality of light emitting diodes, and the array driving unit 76 is used to turn on those of the light emitting diodes of the erasing array 45 which correspond to the range specified by the light spot formed by the light source 43.

Figure 8A:
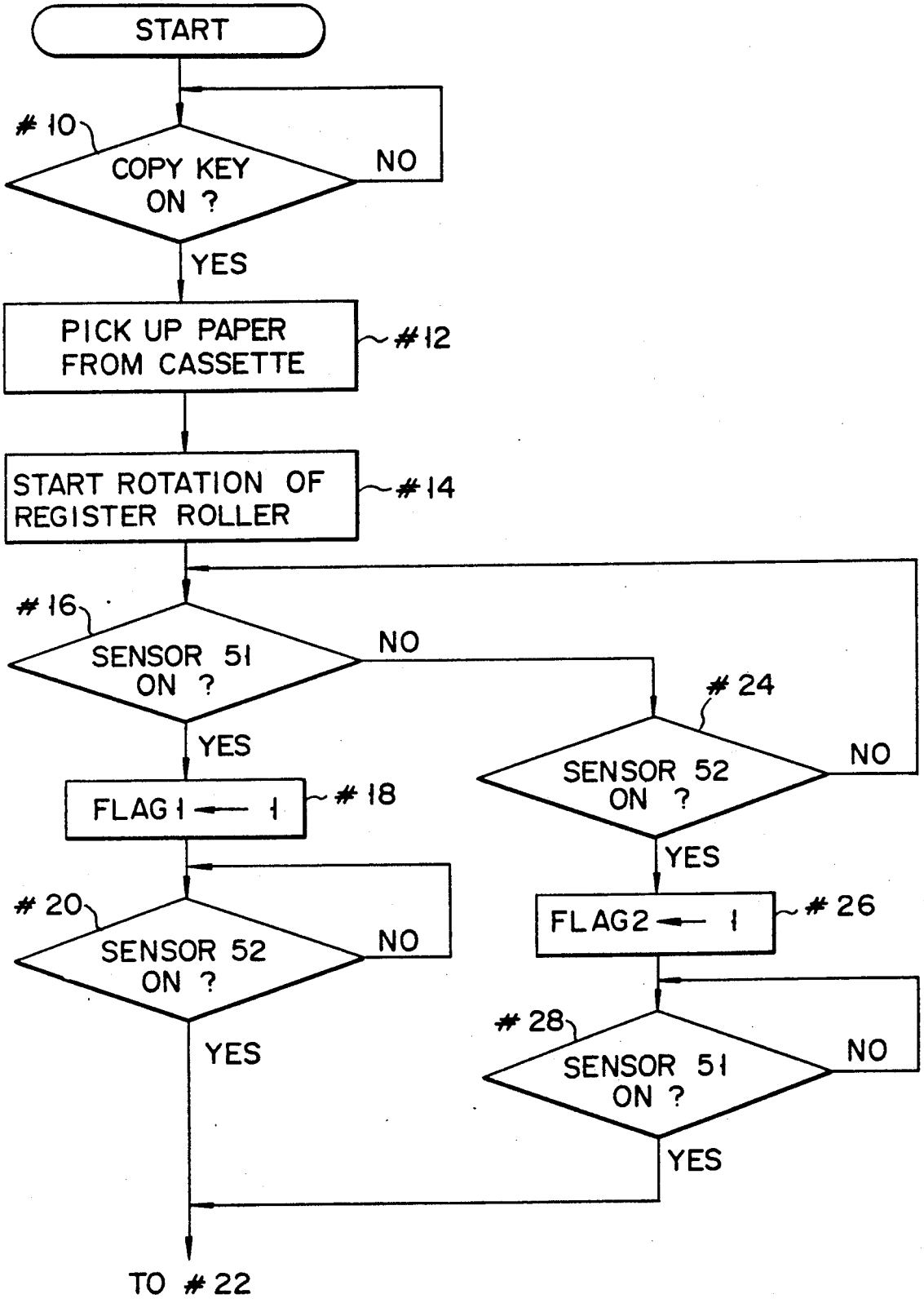
FIG. 8A and 8B are flowcharts illustrating the operation of the first embodiment.
Figure 8B:
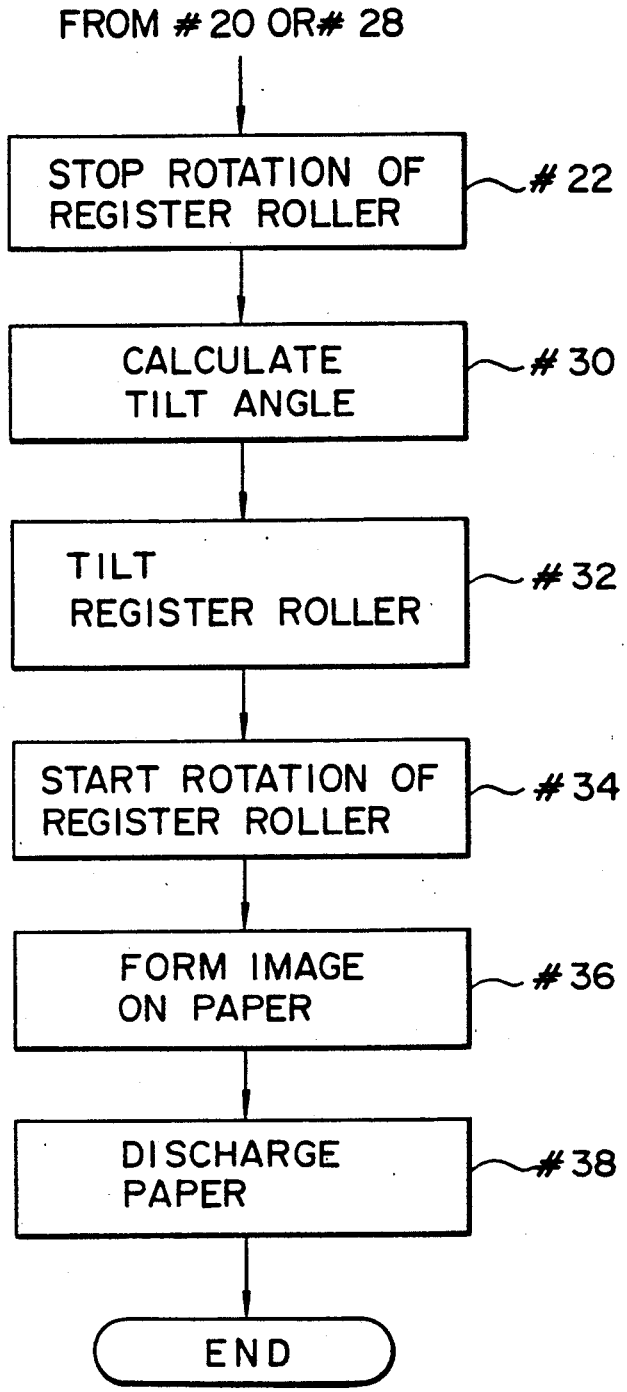

Next, the operation of the embodiment thus constructed is explained with reference to the flowchart shown in FIGS. 8A and 8B. When the operation of the copy key 44*a* is detected in the step #10 with a document set on the document table, paper is taken out from a selected one of the paper supply cassettes 13*a*, 13*b*, and 13*c* in the step #12, and the taken-out paper is fed to the paired register rollers 17. When the paper is fed to the paired register rollers 17, the pulse motor 58 is driven in the step #14 so that the paper can be fed while it is held between the paired register rollers 17. It is determined in the steps #16 and #24 whether the front end of the paper is first detected by the sensor 51 or by the sensor 52.

When it is determined in the step #16 that the front end of the paper is first detected by the sensor 51, a flag 1 is set (=1) in the step #18 and then it is determined in the step #20 whether the sensor 52 is turned on or not. When the sensor 52 is turned on, rotation of the paired register rollers 17 is interrupted in the step #22. On the other hand, when it is detected in the step #24 that the front end of the paper is first detected by the sensor 52, a flag 2 is set (=1) in the step #26 and then it is determined in the step #28 whether the sensor 51 is turned on or not. When the sensor 51 is turned on, rotation of the paired register rollers 17 is interrupted in the step #22.

Figure 9:
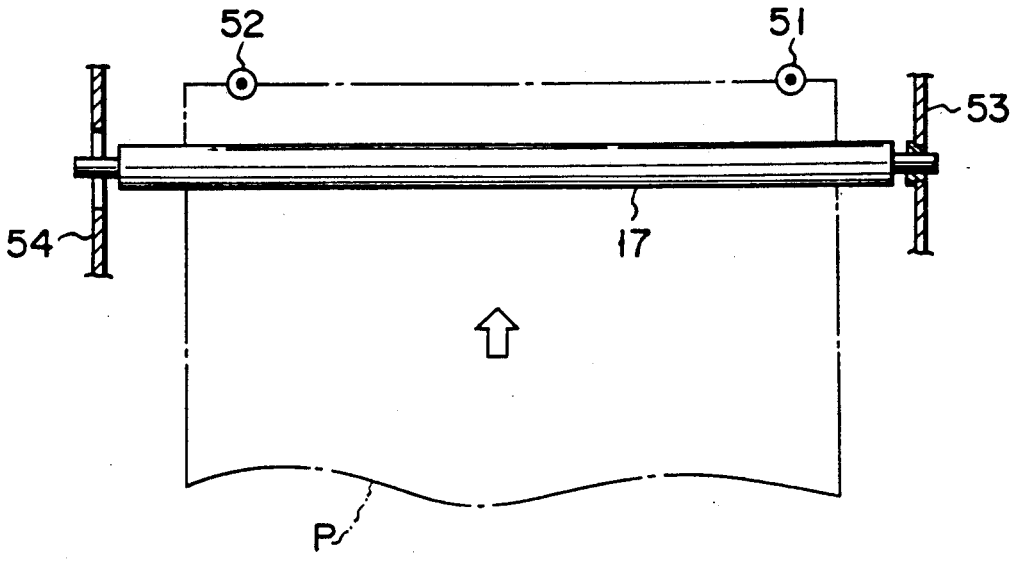
FIG. 9 is a view showing the paper feeding state in which no directional misalignment occurs.

When rotation of the paired register rollers 17 is interrupted, the amount of directional misalignment of the paper (angle of tilt) and the direction of the misalignment (direction of tilt) are derived in the step #30 based on the values of the flag 1 and flag 2 and the number of pulses supplied to the pulse motor 58 in a period from the time when one of the sensors 51 and 52 is turned on until the other sensor is turned on. In this case, if a period between the timings at which the sensors are turned on is extremely short, it is determined that there is no directional misalignment and the amount of directional misalignment is set to 0. That is, as shown in FIG. 9, when the front end of the paper P is detected by the paper front end detection sensors 51 and 52 substantially at the same time, the pulse motor 58 is not practically driven in a period from the time when the front end of the paper is detected by one of the paper front end detection sensors 51 and 52 until the front end of the paper is detected by the other sensor. As a result, in this case, it is determined that there occurs no directional misalignment of the paper.

Figure 10:
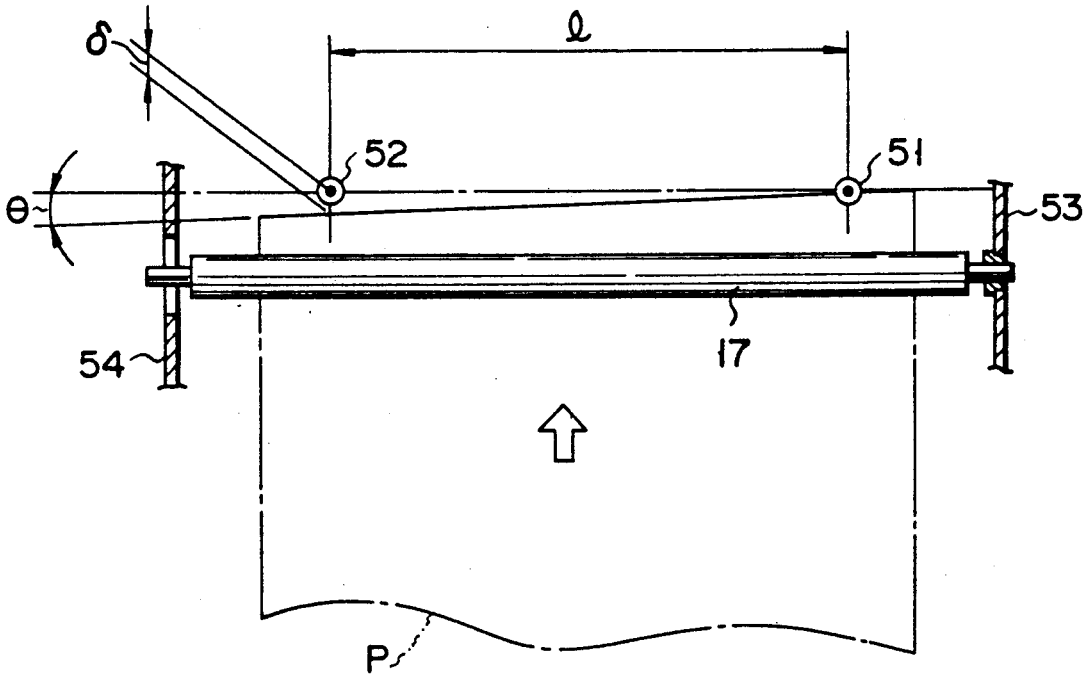
FIG. 10 is a view showing the paper feeding state in which a directional misalignment has occurred.

Further, as shown in FIG. 10, in a case where the right side front end of the paper P is first detected by the paper front end detection sensor 51 and then the left side front end of the paper P is detected by the paper front end detection sensor 52, a distance $\delta$ can be derived based on the number of driving pulses supplied to the pulse motor 58 in a period from the time when the paper is detected by the paper front end detection sensor 51 until the paper is detected by the paper front end detection sensor 52. An angle $\theta$ of tilt of the paper can be derived based on the distance $\delta$ and an interval l between the sensors 51 and 52.

When the angle $\theta$ of tilt is derived as described above, the pulse motor 65 is driven according to the angle $\theta$ of tilt in the step #32 and the paired register rollers 17 are tilted by a corresponding angle in a specified direction so as to correct the directional misalignment of the paper P.

When the directional misalignment of the paper P is corrected, the paired register rollers 17 are rotated again in the step #34 and the pulse motor 78 is driven in the step #36 to drive the photosensitive drum 10. At the same time, the exposure lamp 4 is turned on to effect the exposing/scanning operation with respect to the document set on the document table 2. The pulse motor 58 is driven in synchronism with the timings of the exposing/scanning operation and the developing operation of the electrostatic latent image so that the paper P can be fed between the photosensitive drum 10 and the transferring charger 18 by means of the paired register rollers 17. The paper onto which the toner image is transferred by the transferring charger 18 is separated from the photosensitive drum 10 by the peel-off charger 19 and then fixed by the fixing unit 21. The fixed paper is discharged to the exterior of the main body 1 of the copying machine in the step #38.

As described above, according to the first embodiment, whether or not there is a directional misalignment in the paper which is fed to the image forming section by the paired register rollers 17 is determined by the two paper front end detection sensors 51 and 52 disposed parallel to and on both sides of the paired register rollers 17, and when the directional misalignment has occurred, the paired register rollers 17 are tilted in a direction opposite to that of the detected directional misalignment according to the amount of detected directional misalignment to correct the directional misalignment. Therefore, the directional misalignment can be corrected with the paper held between the paired register rollers 17 so that the directional misalignment can be corrected at a high precision. As a result, the paper fed to the image forming section can be correctly aligned so as to prevent an image from being formed in a deviated position on the paper, thus making it possible to realize a high quality image forming device.

Figure 11:
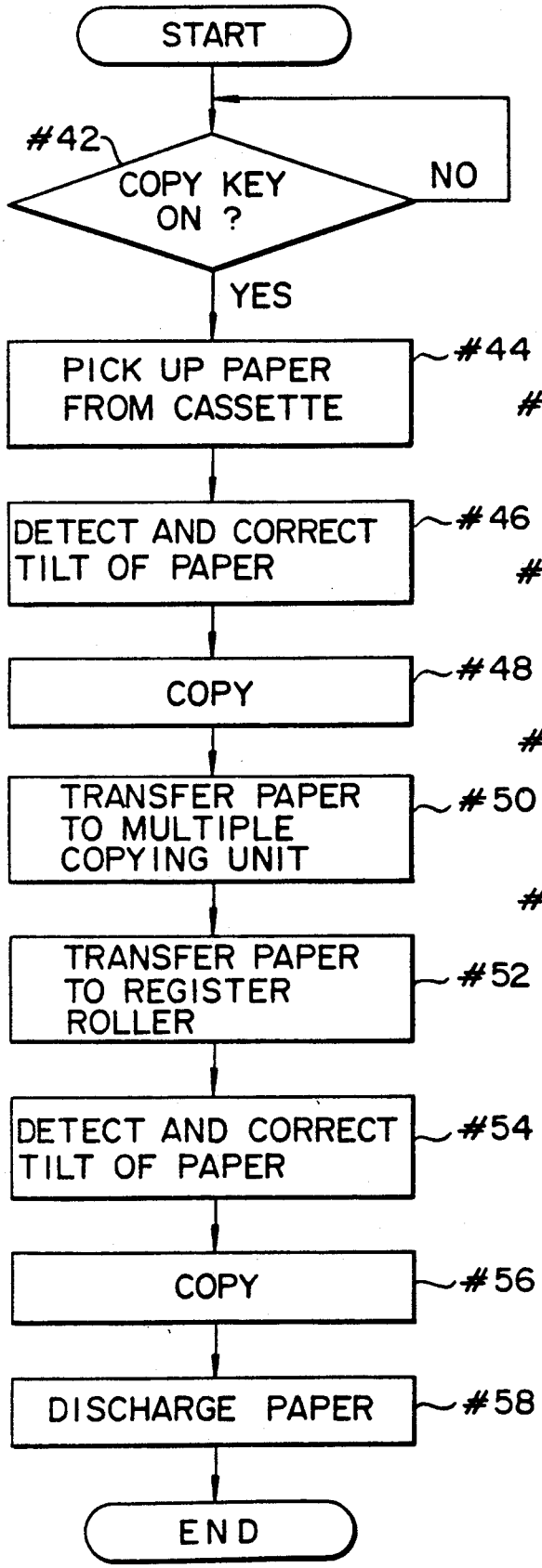
FIG. 11 is a flowchart showing the operation of a modification of the first embodiment.

Next, the operation of multiple copying mode for forming a plurality of images of different colors on the paper is explained as a modification of the first embodiment with reference to FIG. 11. In the multiple copying mode, when a preset area of the document set on the document table 2 is specified by the light spot formed by the light source 43, an image in the specified area can be copied in a color different from that of the other area. That is, after the mode key **44*c* of the operation panel 44 is operated to set the multiple copying mode and a document is placed on the document table 2, the moving key 44*b* of the operation panel 44 is operated to move the spot light source 43 so as to specify a desired area of the document. After this, if the copy key 44*a* is operated in the step #42, paper is taken out form a selected one of the paper supply cassettes 13*a*, 13*b*, and 13*c* in the step #44 and the taken-out paper is fed to the paired register rollers 17. When the paper is fed to the paired register rollers 17, the operation of correcting the directional misalignment of the paper indicated by the steps #14 to #32 as described above is effected in the step #46. When the directional misalignment correction operation is completed, the operation of copying the document set on the document table 2 is effected in the step #48**.

In the copying operation, the erasing array 45 is turned on according to the area specified by the light spot formed by the light source 43 and the charges on a corresponding portion of the photosensitive drum 10 are removed. As a result, since an electrostatic latent image corresponding to the image of the document is not formed on a portion of the photosensitive drum corresponding to the specified area, the portion is kept blank even after the developing operation is effected by using black toner by the developing unit **12*b***. The developed toner image is transferred to the paper and then fixed.

The paper having a document image formed on one surface thereof is fed to the multiple copying unit 28 via the distributing gate 23 shown in FIG. 2 and then stacked in the collecting section **28*a* of the multiple copying unit 28 with the front surface thereof facing downward in the step #50. The paper stacked in the collecting section 28*a* is taken out by the delivery roller 28*e* and fed to the paired register rollers 17 via the paired separation rollers 28*f*, control gate 28*g*, paired feeding rollers 28*h* and paper guide path 28*i* in the step #52**.

When the paper has reached the paired register rollers 17, the operation of correcting the directional misalignment of the paper indicated by the steps #14 to #32 as described above is again effected in the step #54. When the directional misalignment correction operation is completed, the operation of copying the document set on the document table 2 is effected in the step #56.

In the second copying operation, those of the light emitting diodes of the erasing array 45 which correspond to an area other than the area specified by the light spot to remove the charges on the corresponding portion of the photosensitive drum 10 are turned on. As a result, only an electrostatic latent image corresponding to the document image in the area specified by the light spot is formed on the photosensitive drum 10, and the electrostatic latent image thus formed is developed with red toner, for example, by the developing unit **12*a*** which is different from that used in the first copying operation. The developed toner image is transferred onto the paper and then fixed.

The paper having the document image formed with toners of two colors on one surface thereof is discharged to the exterior of the main body 1 of the copying machine via the distributing gate 23 in the step #58.

In the multiple copying mode, correction of the directional misalignment is effected with respect to the paper taken out from the paper supply cassette as well as the paper taken out from the collecting section **28*a* of the multiple copying unit 28**. Therefore, when the multiple copying operation is effected, the directional misalignment between the image copied in the first copying operation and the image copied in the second copying operation can be prevented, thus making it possible to copy an image of good quality.

The multiple copying operation is not limited to the copying operation in which images inside and outside the specified area are copied in different colors as described above.

Figure 12B:
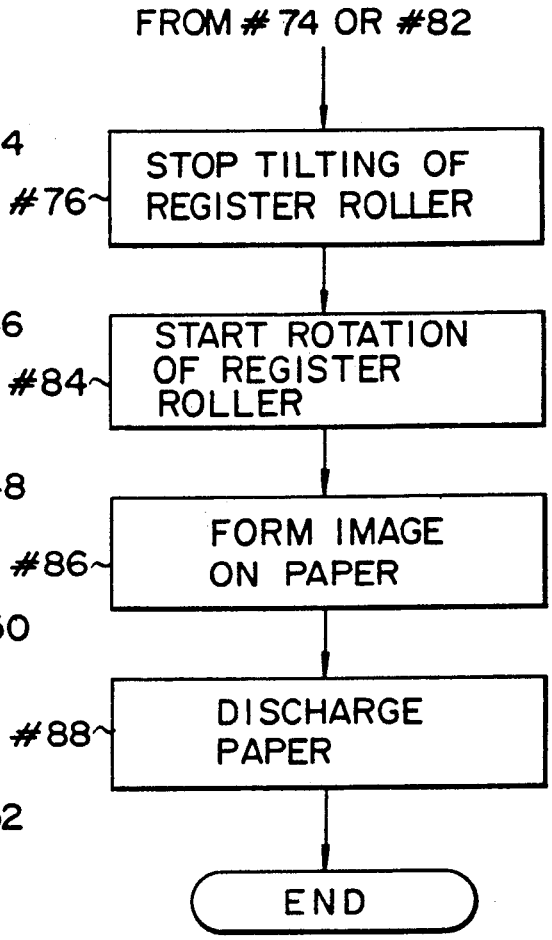
FIGS. 12A and 12B are flowcharts illustrating the operation of a second embodiment.
Figure 12A:
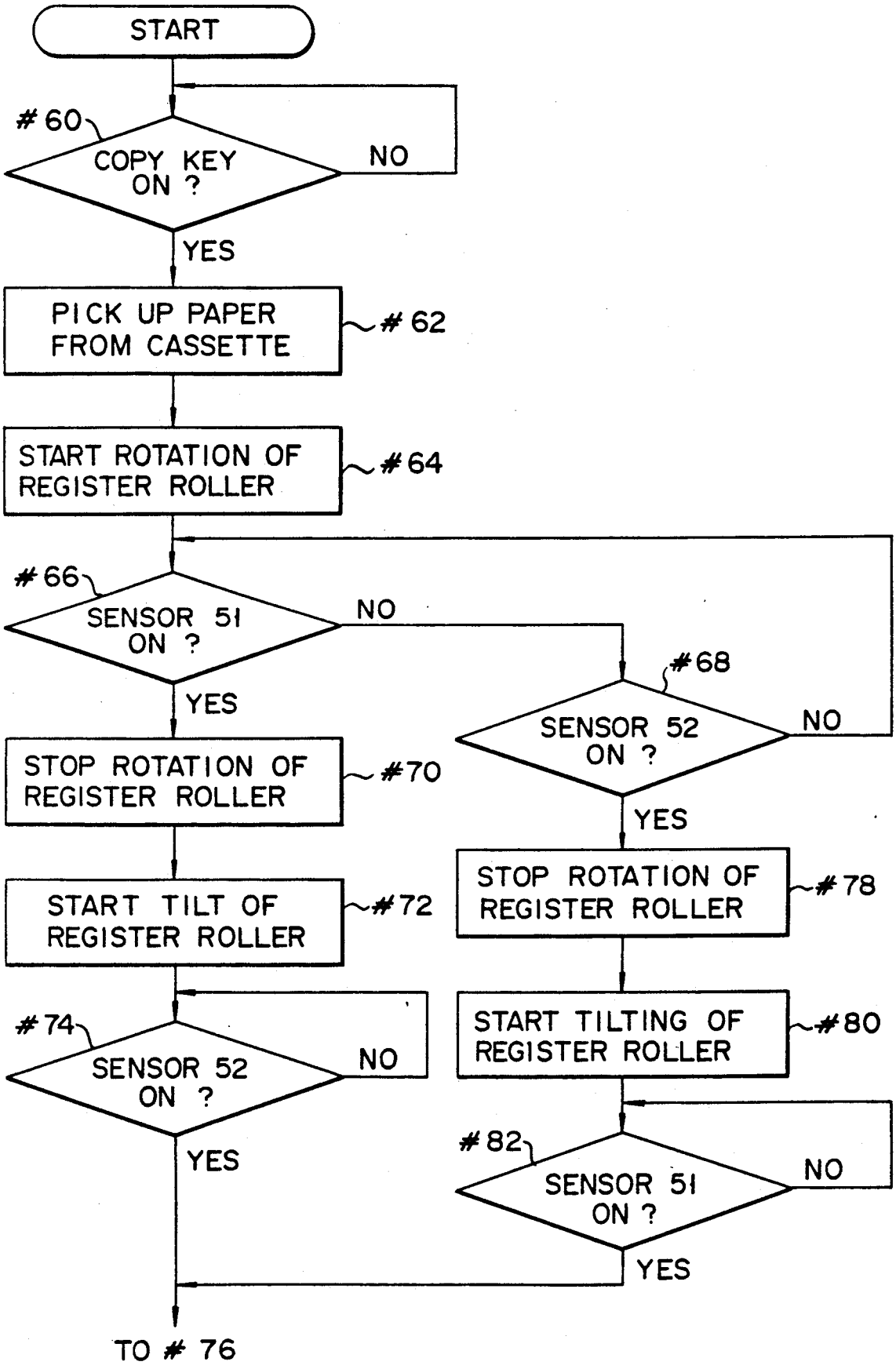

Next, a second embodiment is explained. Since the construction of the second embodiment is the same as that of the first embodiment, the drawing therefor is omitted. In the second embodiment, the directional misalignment is detected and corrected in a manner different from that of the first embodiment. In the first embodiment, the timings at which the two sensors are turned on are detected, the angle of the directional misalignment is derived based on the time difference between the turn-on timings, and then the paired register rollers 17 are tilted in a direction opposite to that of the directional misalignment according to the derived angle of tilt. However, in the second embodiment, when either one of the sensors is turned on, the operation of correcting the directional misalignment or the tilt of the paired register rollers 17 is started. This operation is explained with reference to the flow chart shown in FIGS. 12A and 12B. When the operation of the copy key **44*a* is detected with a document set on the document table 2 in the step #60, paper is taken out from a selected one of the paper supply cassettes 13*a*, 13*b***, and 13c in the step #62 and the taken-out paper is fed to the paired register rollers 17. When the paper has reached the paired register rollers 17, the pulse motor 58 is driven in the step #64 so that the paper can be fed while it is held between the paired register rollers 17. It is determined in the step #66 and #68 whether the front end of the paper is first detected by the sensor 51 or by the sensor 52.

Figure 13:
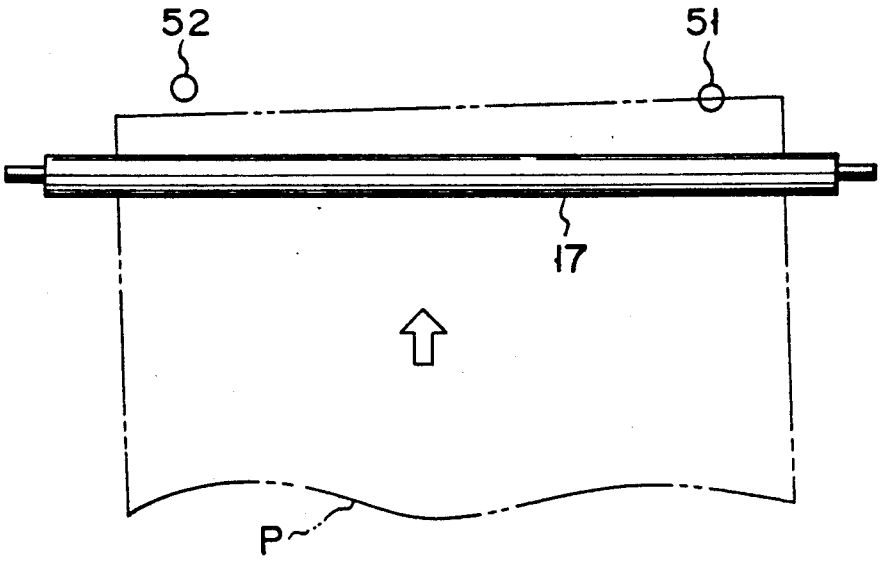
FIG. 13 is a view showing the paper feeding state at the time of detection of directional misalignment.
Figure 14:
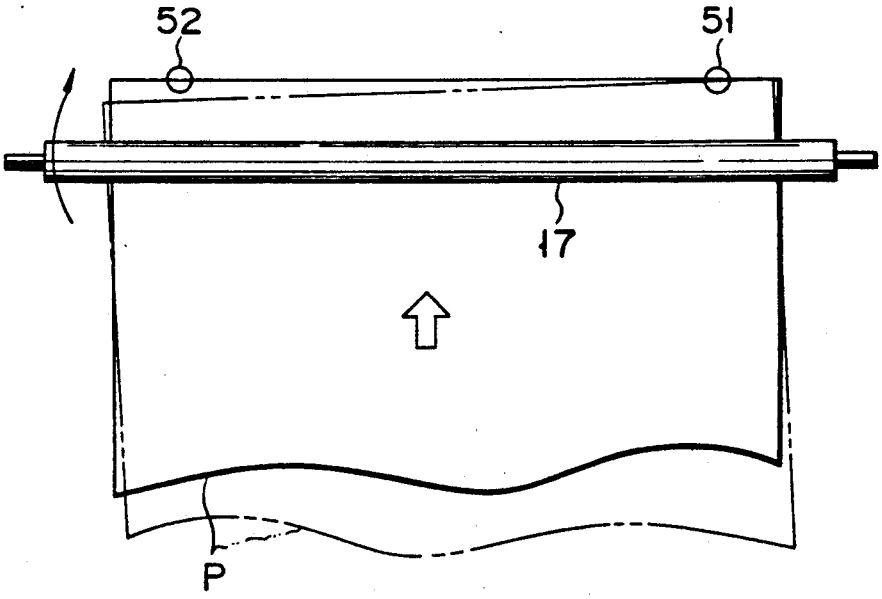
FIG. 14 is a view showing the operation of correcting the directional misalignment shown in FIG. 13.

When it is determined in the step #66 that the front end of the paper is first detected by the sensor 51, rotation of the paired register rollers 17 is interrupted in the step #70. FIG. 13 shows the relation between the paper and the paired register rollers 17 set up at this time. The operation of tilting the paired register rollers 17 is started in the step #72. Since the paper is tilted in a counterclockwise direction, the paired register rollers 17 are tilted in a clockwise direction as shown in FIG. 14. Then, it is determined in the step #74 whether or not the sensor 52 is turned on. When it is determined that the sensor 52 is turned on, the operation of tilting the paired register rollers 17 is interrupted in the step #76. At this time, since the sensors 51 and 52 are both set in the ON state, the front end of the paper is set parallel to the paired register rollers 17 and there is not directional misalignment.

Figure 15:
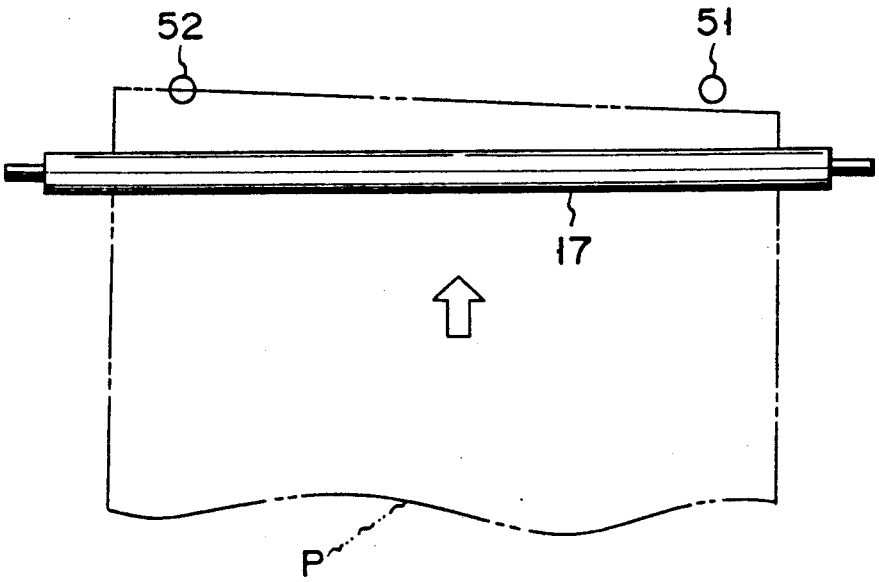
FIG. 15 is a view showing the paper feeding state when the directional misalignment, which has occurred in the reverse direction with respect to the case of FIG. 13, is detected.
Figure 16:
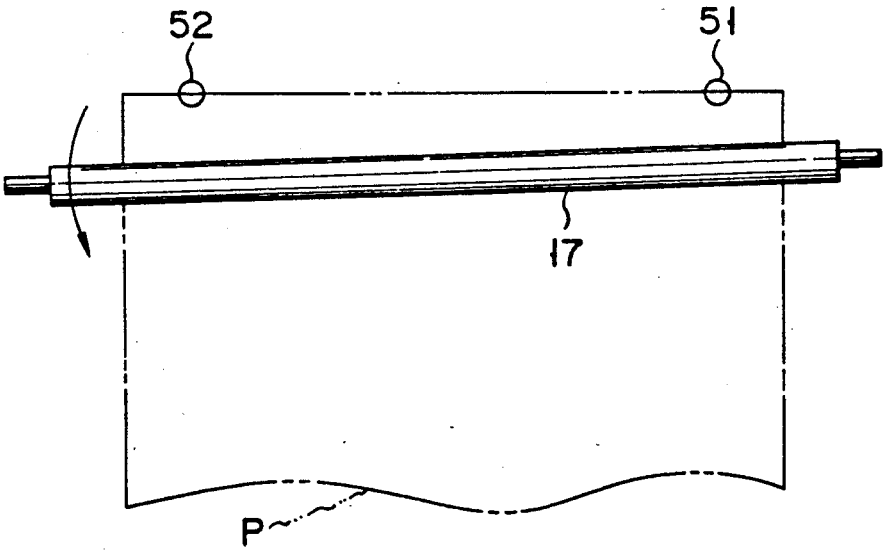
FIG. 16 is a view showing the operation of correcting the directional misalignment shown in FIG. 15.

On the other hand, when it is determined in the step #68 that the front end of the paper is first detected by the sensor 52, rotation of the paired register rollers 17 is interrupted in the step #78. FIG. 15 shows the relation between the paper and the paired register rollers 17 set up at this time. Then, the operation of tilting the paired register rollers 17 is started in the step #80. Since the paper is tilted in a clockwise direction at this time, the paired register rollers 17 are tilted in a counterclockwise direction as shown in FIG. 16. Then, it is determined in the step #82 whether or not the sensor 51 is turned on. When it is determined that the sensor 51 is turned on, the operation of tilting the paired register rollers 17 is interrupted in the step #76. At this time, since the sensors 51 and 52 are both set in the ON state, the front end of the paper is set parallel to the paired register rollers 17 and there is no directional misalignment.

In this way, when the directional misalignment of the paper P is corrected, rotation of the paired register rollers 17 is started again in the step #84 and the pulse motor 78 is driven in the step #86 so as to drive the photosensitive drum 10, and at the same time, the exposure lamp 4 is turned on to expose and scan the document set on the document table 2. The pulse motor 58 is driven in synchronism with the timings of the exposing/scanning operation and the developing operation of the electrostatic latent image so that the paper P can be fed between the photosensitive drum 10 and the transferring charger 18 by means of the paired register rollers 17. The paper onto which the toner image is transferred by the transferring charger 18 is separated from the photosensitive drum 10 by the peel-off charger 19 and then fixed by the fixing unit 21. The fixed paper is discharged to the exterior of the main body 1 of the copying machine in the step #88.

As described above, according to the second embodiment, in addition to the effect obtained in the first embodiment, there is obtained an effect that the directional misalignment can be corrected by a simple control operation since an operation of deriving the amount of directional misalignment of the paper is not necessary and that time required for correcting the directional misalignment can be shortened since the correcting operation is effected while the directional misalignment is being detected. In the second embodiment, it is also possible to effect the modified multiple exposing mode as shown in FIG. 11 in the same manner as in the first embodiment.

This invention is not limited to the above embodiments and can be variously modified. For example, in the above embodiments, the image forming operation is effected after the amount of the directional misalignment of the paper is detected and the directional misalignment is corrected. However, this invention is not limited to this and the image forming operation can be effected while the amount of the directional misalignment of the paper is being detected and the directional misalignment is being corrected. Further, means for coupling the paired register rollers 17 with the frame is not limited to the self-aligning bearings, but the bearing portions of the driving and following rollers can be formed of only ball bearings when the angle of the paired register rollers to be tilted is small. In addition, the paired register rollers and the photosensitive drum are driven by the different motors, but they can be driven by the same motor. The paired register rollers are tilted with the frame 53 set as the fulcrum, but it is also possible to provide a movable plate 59 on the side of the frame 53 of the paired register rollers and a pulse motor 65 for driving the movable plate. In this case, the movable plate can be moved by means of the pulse motor disposed on the side of the frame 53 so as to tilt the paired register rollers with the frame 54 set as the fulcrum when the front end of the paper is first detected by the sensor 52. With this construction, the directional misalignment can be corrected in the same manner as in the above embodiment. Further, when the directional misalignment is detected, the directional misalignment can be corrected by adjusting the optical system when an electrostatic latent image is formed instead of tilting the paired register rollers.

As described above, according to this invention, there is provided an image forming apparatus in which the directional misalignment of the image forming medium fed by the feeding means can be detected by the detection means, and the directional misalignment of the image forming medium held by the feeding means can be corrected by tilting the feeding means in a direction opposite to that of the directional misalignment by an amount of the directional misalignment, thereby making it possible to form an image onto the medium without causing misalignment.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An image forming apparatus comprising:

means for forming an image on an image forming medium;

feeding means for feeding and supplying said image forming medium to said image forming means;

means for detecting a tilting of said image forming medium fed by said feeding means, in relation to the feeding direction; and means for tilting said feeding means on a plane on which said image forming medium is fed, according to the tilting detected by said detection means, to correct the tilting of said image forming medium.

2. An apparatus according to claim 1, in which said detection means includes two image forming medium detecting means arranged in a direction perpendicular to the feeding direction of said image forming medium and arithmetic operation means for deriving a tilt based on a difference between timings at which said two detecting means are turned on.

3. An apparatus according to claim 2, in which said arithmetic operation means includes means for detecting the direction of the tilt according to which of said two detecting means is first turned on and detecting the angle of tilt based on the difference between the timings at which said two detecting means are turned on.

4. An apparatus according to claim 3, in which said tilt correction means includes means for tilting said feeding means in a direction opposite to the detected direction of the tilt by the detected angle of tilt.

5. An apparatus according to claim 1, in which said detection means includes two image forming medium detecting means arranged in a direction perpendicular to the feeding direction of said image forming medium and means for detecting the direction of tilt according to which of said two detecting means is first turned on.

6. An apparatus according to claim 5, in which said tilt correction means includes means for tilting said feeding means in a direction opposite to the detected direction of the tilt in a period from the time when one of said detecting means is turned on until the other detecting means is turned on.

7. A method for correcting directional misalignment of an image forming medium in an image formation device for forming an image on the image forming medium, while the image forming medium is being fed by paired rollers disposed in front of said image forming means, said method comprising the steps of:

interrupting the rotation of said paired rollers after said image forming medium is held therebetween;

detecting the direction and angle of a tilt of said image forming medium which is held between said paired rollers;

tilting said paired rollers in a plane on which said image forming medium is held and in a direction opposite to a detected direction of tilt and by the detected angle of tilt; and around a point located on a line along an axial direction of the paired roller, so as to correct directional misalignment of said image forming medium; and restarting rotation of said paired rollers, to feed said image forming medium into said image forming means.

8. An image forming apparatus comprising:

paired rollers for holding and feeding a supplied image recording medium;

image forming means for forming an image on said image recording medium fed by said paired rollers;

detection means disposed between said paired rollers and said image forming means, for detecting directional misalignment of said image forming medium; and correction means for tilting the paired rollers holding and feeding said image forming medium in a direction opposite to the directional misalignment and around a point located on a line along an axial direction of the paired rollers, so as to correct directional misalignment of said image forming medium based on an output from said detection means.

9. An apparatus according to claim 8, in which said paired rollers are mounted on a housing of said device via self-aligning bearings so as to be tilted in an image forming medium feeding plane, and said correction means includes means for tilting said paired rollers in a direction opposite to the direction of the detected directional misalignment by an angle of the detected directional misalignment.

10. An apparatus according to claim 9, in which said tilting means includes means disposed along said housing, for moving one-end portions of said paired rollers back and forth in the feeding direction according to an output of said detection means.

11. An apparatus according to claim 8, in which said detection means includes two medium front end detecting sensors disposed parallel to said paired rollers and means for detecting a direction of the directional misalignment according to which of said two sensors is first turned on and deriving an angle of the directional misalignment based on a difference between timings at which said sensors are turned on.

12. An apparatus according to claim 8, in which said detection means includes two medium front end detecting sensors disposed parallel to said paired rollers and means for detecting a direction of the directional misalignment according to which one of said two sensors is first turned on.

13. An apparatus according to claim 12, in which said correction means includes means for tilting said paired rollers in a direction opposite to the detected direction in a period from the time when one of said sensors is turned on until the other sensor is turned on.

14. An apparatus according to claim 8, wherein said correction means comprises means for tilting said paired rollers on a plane in which said image recording medium is held.

15. A method for correcting directional misalignment of an image forming medium in an image formation device for forming an image on the image forming medium, while the image forming medium is being fed by paired rollers disposed in front of said image forming means, said method comprising the steps of:

interrupting rotation of said paired rollers after the image forming medium held therebetween is detected as having an angle of tilt;

tilting said paired rollers on a plane on which the image forming medium is held and in a direction opposite to the detected direction of tilt around a point located on a line along an axial direction of the paired rollers;

stopping tilting of said paired rollers when the image forming medium is detected as no longer being tilted; and restarting rotation of said paired rollers, to feed said image forming medium into said image forming means.

* * * * *